United States Patent [19]

Broughton

[11] 3,937,235

[45] Feb. 10, 1976

[54] TOOTHBRUSH WITH PASTE CARTRIDGE

[76] Inventor: John B. Broughton, 7082 Goodview, Riverside, Calif. 92506

[22] Filed: Dec. 5, 1974

[21] Appl. No.: 529,849

[52] U.S. Cl. ..... 132/84 B; 401/186

[51] Int. Cl.[2] ..... A45D 44/18

[58] Field of Search ..... 132/84 R, 84 B, 84 D; 401/183, 184, 186

[56] References Cited

UNITED STATES PATENTS

| | | | |
|---|---|---|---|
| 1,875,184 | 8/1932 | Steigleder | 401/186 |
| 2,226,663 | 12/1940 | Hill et al. | 401/184 |
| 2,416,684 | 3/1947 | Fischer | 401/186 |
| 2,441,520 | 5/1948 | Ulvick | 401/183 |
| 2,987,743 | 6/1961 | Capps | 132/84 B |

*Primary Examiner*—G. E. McNeill

*Attorney, Agent, or Firm*—Allen A. Dicke, Jr.

[57] ABSTRACT

Toothbrush handle includes reservoir for pressurized toothpaste. Outflow of toothpaste is controlled by a ball valve which is unseated by motion of the tooth with respect to its handle. Passages through the shank of the brush into the brush back and directed into the bristles convey the toothpaste into the bristle zone.

8 Claims, 5 Drawing Figures

TOOTHBRUSH WITH PASTE CARTRIDGE

BACKGROUND

This invention is directed to a fountain toothbrush with a paste cartridge, and particularly a toothbrush having a pressurized paste cartridge which supplies paste to the bristle area upon demand by the user.

Dental prophylaxis on a regular basis has become a customary portion of personal cleanliness. A variety of toothbrushes are available to individuals for the periodic and regular cleaning of teeth. Furthermore, specialized cleaning materials in the form of toothpastes and powders are available to aid in this lavation. It is customary to choose a toothbrush and a toothpaste and employ them regularly to minimize more serious dental care.

A number of steps forward have been made to improve the convenience or efficiency of tooth cleaning. Electric toothbrushes provide powered motion of the bristles; fountain toothbrushes provide means whereby toothpaste is furnished to the bristles. Prior fountain toothbrushes, however, require squeezing of a standard toothpaste tube and have complex structures to thus accomplish the discharge of toothpaste to the brush. These former devices are more complex and, accordingly, more expensive and less likely to continue working for long life.

SUMMARY

In order to aid in the understanding of this invention, it can be stated in essentially summary form that it is directed to a toothbrush with paste cartridge wherein the cartridge serves as a toothbrush handle. Pressurized paste is positioned in the handle, and a valve controls outflow of the pressurized paste. The brush has a shank with the shank extending into the handle so that, upon motion of the brush with respect to the handle, the valve is opened, and paste is discharged through channels in the shank into the bristle area.

It is thus an object of this invention to provide a toothbrush with pressurized paste cartridge so that paste can be discharged as required. It is a further object to provide a toothpaste cartridge which contains pressurized toothpaste and which can be fitted with a brush so that, when fitted, the paste can be discharged into the bristles of the brush. It is a further object to provide a paste cartridge having a valve therein, with the valve operable by the brush to discharge pressurized toothpaste into the bristle area of the brush. Other objects and advantages of this invention will become apparent from a study of the following portion of the specification, the claims, and the attached drawings.

DESCRIPTION OF THE PREFERRED EMBODIMENT

Figure 1:
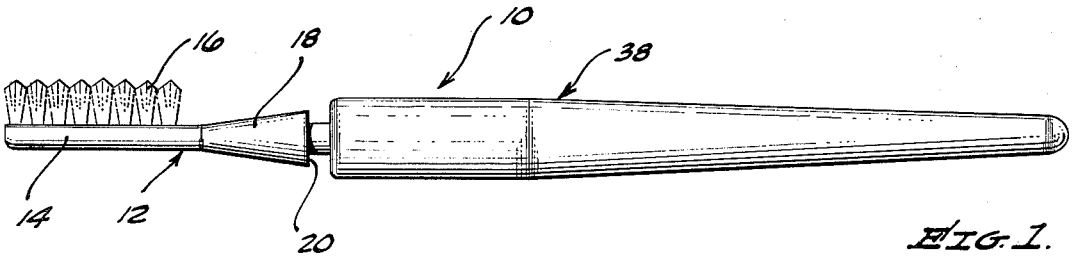
FIG. 1 is a side-elevational view of the toothbrush with paste cartridge of this invention.
Figure 2:
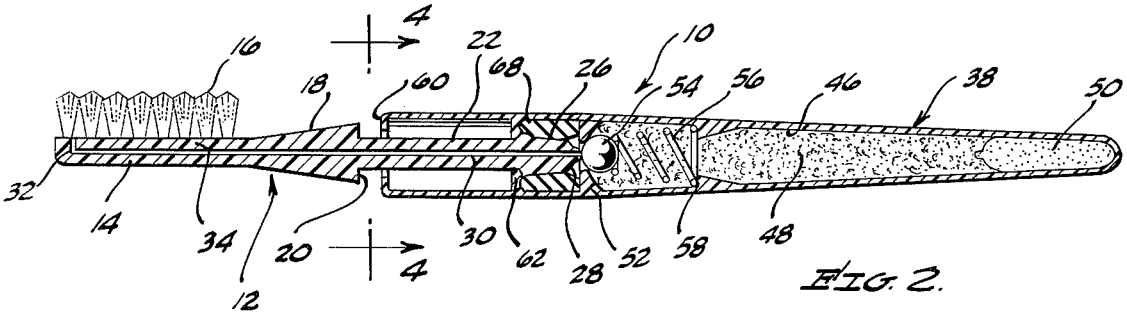
FIG. 2 is a longitudinal section therethrough.

The toothbrush with paste cartridge is generally indicated at 10 in FIGS. 1 and 2. Brush 12 has brush back or head 14 which contains bristles 16. The head is mounted on shank 18 which expands in a taper to shoulder 20. Beyond shoulder 20, shank 18 has a straight guide section 22 of substantially square configuration, with rounded corners. Beyond the straight guide section 22 is stop shoulder 24 which faces shoulder 20. Stop shoulder 24 merges into conical section 26 which, in turn, merges into hemispherical end 28. Duct 30 extends from the hemispherical end 28 through the shank and into head 14. In head 14, duct 30 opens through two side branches 32 and 34 to the side of head 14 which carries bristles 16. The bristles comprise two rows of natural or nylon bristles inserted into the head 14. The duct with its branches permits discharge of toothpaste into the bristles of brush 12. Duct 30 opens out of hemispherical end 28. Next to the opening is finger 36. The duct or the finger may be on the center line of the shank, but preferably they are both slightly displaced from the center line so that the access to duct 30 is beside finger 36.

Figure 5:
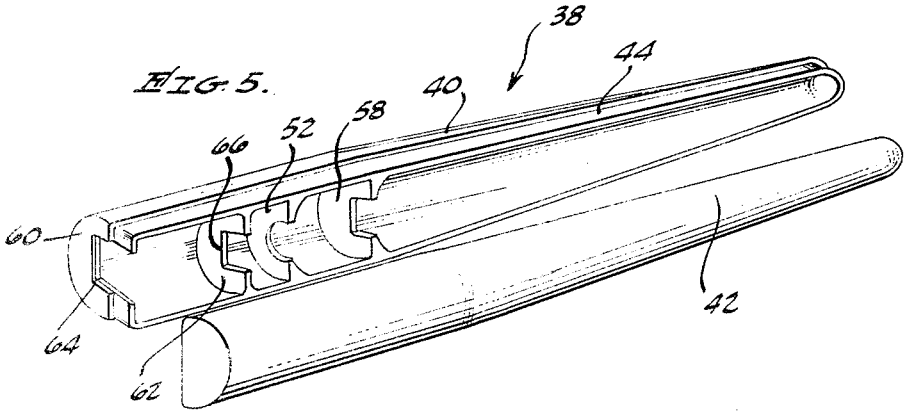
FIG. 5 is an exploded view, showing the two housing halves of the paste cartridge separated from each other to show the interior structure thereof.

Handle 38 serves as a means for conveniently holding and using the toothbrush and also serves as a fountain reservoir of toothpaste which can be discharged through duct 30 into the bristles. The handle serves as a toothpaste cartridge to supply toothpaste when desired. Handle 30 is formed of two complementary handle halves 40 and 42, see FIG. 5, which are complementary and interlocking with appropriate flanges to assemble into a secure handle toothpaste cartridge. In assembly, flange 44 can fit into the corresponding recess so that adhesive fastening or welding can be achieved. The two handle halves will act together to form reservoir 46 which contains paste 48. Toothpaste 48 is of conventional viscosity, as is found in today's usual toothpaste tubes so that it may be extruded out of branches 32 and 34 into the bristles. Pressurization of toothpaste 48 is achieved by forming a closed polycarbonate bag 50, as by ultrasonic welding, which contains a few drops of polytetrafluoroethylene (Freon-TM). At room temperature, the polytetrafluoroethylene expands to pressurize the paste 48. The pressure desired dictates the type of polytetrafluoroethylene chosen for this task.

Valve seat 52 has ball 54 seated thereon. Spring 56 resiliently retains the ball in its seat to close passage of pressurized paste through the valve seat out of the paste reservoir. Spring 56 also engages upon spring seat 58 formed in the wall of the reservoir.

Figure 3:
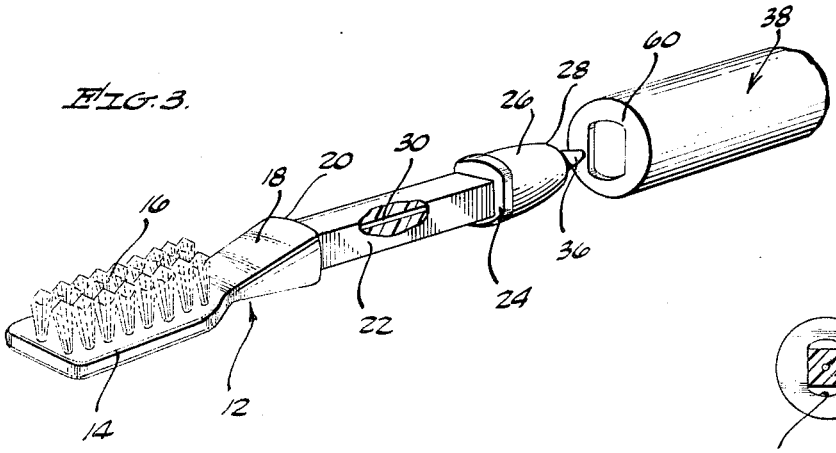
FIG. 3 is an enlarged perspective view, with parts broken away, showing the brush separated from the cartridge.
Figure 4:
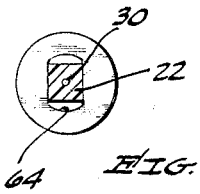
FIG. 4 is a section taken generally along the line 4—4 of FIG. 2.

Guide flanges 60 and 62 extend inwardly toward the brush end of handle 38. They have guide openings 64 and 66 therein to receive and guide the guide section 22 of shank 18. Guide flanges 60 and 62 are sufficiently resilient so that the conical section 26 can be pressed therethrough so that stop shoulder 24 engages on the back of guide flange 62. As is seen in FIGS. 3 and 4, the guide opening 64 and also its companion guide opening 66 need not be a very close fit within guide section 22. These guide openings need to restrain and guide brush 12 within handle 38 and to prevent withdrawal of the brush with ordinary forces. Finger 36 engages against ball 54 to hold the brush to the left, and this is adequate force to maintain the brush structure in the left position for brushing. Rightward thrust of brush 12 with respect to handle 38 causes finger 36 to unseat ball 54 to permit pressurized toothpaste to flow to the left, entering duct 30 to be discharged into bristles 16. Seal ring 68 is an elastomeric, annular ring which is positioned within the handle between seat 52 and guide flange 62. Seal ring 68 engages against the conical section 26 to seal with respect thereto. The seal ring also urges the brush to the left to enhance brush stability during the brushing operation.

Toothbrush 10 thus combines brush 12 with handle 38 which comprises a paste cartridge. Brush 12 is a separate unit which snaps into the pressurized toothpaste-containing handles 38. As described, moving the brush to the right permits the discharge of pressurized paste through duct 30 into the bristles for use. Bristles 16 comprise preferably two rows of natural or nylon bristles inserted into brush head 14. Brush 12 is preferably of injection-molded polystyrene material or other similar material. The flexibility of guide flanges 60 and 62 permit the insertion of brush 12 so that they snap together. The flat sides of guide section 12 prevent any twisting or slipping out of alignment. In use, finger 36 unseats rubber valve ball 54 to release toothpaste 48 which is pressurized by the gas contained in pressure bag 50. Of course, handle 38 is held in the hand, and the warming of the handle from that source increases the pressure so that adequate pressure is available when needed. Even flow of the toothpaste results, as the pressurized bag full of Freon extrudes the paste into bristles 16. The brush is then used in conventional manner, and the bristles can be washed under running water. The toothbrush with its paste cartridge can be repeatedly used in conventional manner until the toothpaste in a particular handle 30 is exhausted. Thereupon, brush 12 is pulled from handle 38, and the old handle section is discarded.

Toothpaste cartridges in the form of handle 38 can be separately marketed to serve as a refill package. The old brush 12 is then inserted into the new handle 38 by snapping it into position. Thereupon, it is ready for continued use.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A toothbrush with paste cartridge comprising:

a reservoir for containing toothpaste and a vaporizing-material-pressurized closed resilient bag in said reservoir for pressurizing toothpaste in said reservoir, an outlet from said reservoir, a brush mounted on and connected to the outlet of said reservoir so that said brush is axially movably mounted with respect to said reservoir, a valve at the outlet of said reservoir for controlling flow of paste from said reservoir to said brush said brush occupying a first axial position in a first direction when said valve is closed and said brush having a shank which engages said valve and opens said valve when said brush is in a second axial position with respect to said reservoir for permitting pressurized paste to flow from said reservoir to said brush.

2. The toothbrush with paste cartridge of claim 1 wherein said brush is removably mounted with respect to said reservoir.

3. The toothbrush with paste cartridge of claim 1 wherein said paste cartridge comprises a handle and said reservoir is within said handle.

4. A toothbrush with paste cartridge comprising:

a handle and a brush mounted on said handle, a reservoir for containing toothpaste within said handle, said reservoir having a pressurized bag having volatile liquid therein for pressurizing toothpaste in said reservoir, said handle being formed of complementary handle halves interlocked together and sealed together so that a portion of said handle halves act together to form said reservoir, valve seat flanges extending from said handle halves and adjoining each other to define a valve seat, a valve ball on said valve seat, a spring seat formed as flanges in said handle halves and a spring mounted on said spring seat and urging said ball to close said valve seat, first and second guide flanges formed on each of said handle halves and forming guide openings in line with said valve seats said brush having a guide section engaged in said guide openings, said brush having a stop shoulder thereon engaging behind said first guide flange to resiliently limit motion of said brush with respect to said handle, said brush having a shank thereon which engages said valve ball and moves said valve ball off of its seat when said brush is moved through said guide flanges to permit discharge of toothpaste from said reservoir as a result of expansion of said pressurized bag in toothpaste in said reservoir.

5. The toothbrush with paste cartridge of claim 4 wherein said valve engaging means comprises a finger on said brush, said finger extending beyond said stop shoulder.

6. The toothbrush with paste cartridge of claim 5 wherein a resilient annular seal ring engages around said brush between said finger and said stop shoulder to prevent paste flow around said stop shoulder.

7. A paste cartridge for a toothbrush comprising:

a handle, a toothpaste reservoir within said handle, a pressurized vaporizable-liquid-containing flexible closed bag within said reservoir for pressurizing toothpaste within said reservoir to expel toothpaste from said reservoir, a valve seat having an opening therethrough comprising a toothpaste discharge opening from said reservoir, a ball seated in said valve seat for preventing toothpaste discharge, a guide opening in said handle, said guide opening being aligned with said opening in said valve seat so that the shank of a toothbrush having a duct therethrough can be axially inserted through said guide opening to axially engage said valve ball and lift said valve ball from its seat to permit discharge of paste into said duct.

8. The paste cartridge of claim 7 further including a resilient seal ring within said handle adjacent said guide opening and adjacent said valve seat so that, when a toothbrush shank is inserted through said guide opening, said seal ring can seal on the toothbrush shank.

* * * * *